US005647392A

United States Patent [19]

Roche

[11] Patent Number: 5,647,392

[45] Date of Patent: Jul. 15, 1997

[54] AIR REGULATION SYSTEM FOR HYDROPNEUMATIC RESERVOIR

[75] Inventor: Emile Roche, Bourg-en-Bresse, France

[73] Assignee: Charlatte, Migennes, France

[21] Appl. No.: 535,138

[22] PCT Filed: Mar. 23, 1994

[86] PCT No.: PCT/FR94/00317

§ 371 Date: Nov. 2, 1995

§ 102(e) Date: Nov. 2, 1995

[87] PCT Pub. No.: WO94/21957

PCT Pub. Date: Sep. 29, 1994

[30] Foreign Application Priority Data

Mar. 25, 1993 [EP] European Pat. Off. ..... 93400771

[51] Int. Cl.[6] ..... F17D 1/20

[52] U.S. Cl. ..... 137/207; 137/211.5

[58] Field of Search ..... 137/207, 211.5

[56] References Cited

U.S. PATENT DOCUMENTS 3,347,256 10/1967 Massey et al. .

4,182,358 1/1980 Sinelnikov et al. .

FOREIGN PATENT DOCUMENTS 2 416 417 4/1982 France .

*Primary Examiner*—Gerald A. Michalsky

*Attorney, Agent, or Firm*—Beveridge, Degrandi, Weilacher & Young, LLP

[57] ABSTRACT

An air regulation system for a hydropneumatic reservoir of a hydraulic conduit includes a chamber, a water filling device for the chamber, a water emptying device for the chamber, an automatic air introduction device for introduction of air in the chamber during emptying, an automatic injection device for injecting air from the chamber to the reservoir during filling, and a control device connected to at least one excess sensor for sensing the overpassing of a threshold level of water contained in the reservoir and also connected to a chamber filling and emptying assembly. If the sensor indicates an insufficient air volume in the reservoir, the control device initiates chamber filling/emptying cycles until the sensor indicates that the air volume in the reservoir is sufficient.

27 Claims, 5 Drawing Sheets

AIR REGULATION SYSTEM FOR HYDROPNEUMATIC RESERVOIR

Figure 1B:
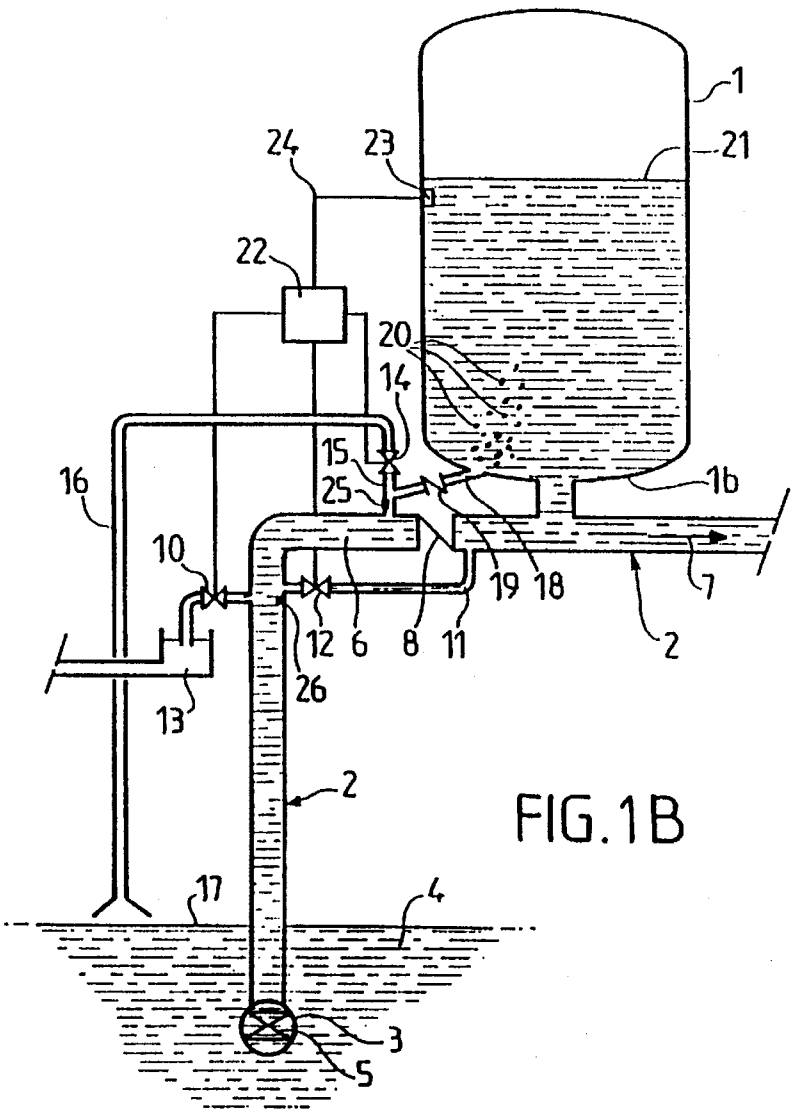

The present invention relates to an air regulation system for a hydropneumatic reservoir equipping a water pipe which may be a network for distributing drinking water or irrigation water, or a network for discharging waste water or chemical liquids.

The hydropneumatic reservoir may operate as a regulation reservoir (or hydrophore) for regulating the pumping pressure and ensuring continuity of the service in the pipe, within a pressure range between a high threshold and a low threshold. When the high pressure threshold is exceeded, the pump (or one of the pumps) feeding the pipe is shut down. The regulation reservoir then tops the pipe up with water. When the low threshold is reached, the pump is started up again to ensure sufficient pressure in the pipe.

The hydropneumatic reservoir may also be used as a reservoir for preventing water hammer in a water pipe, so as to compensate depression and overpressure effects brought about for example by shutting down a pump or closing a valve. The operation of such a reservoir is known especially from French Patent No. 2 416 417 (ROCHE).

A significant problem in ensuring the correct operation of the hydropneumatic reservoir lies in maintaining a constant volume of air in the reservoir. This is because, in operation, the hydropneumatic reservoir contains water or some arbitrary liquid flowing into the pipe, and air trapped in the reservoir just above the surface of the water. The dissolving of air in water or, conversely, the release of gas from the liquid which may occur under certain circumstances, create a variation in the volume of air trapped in the reservoir. It is therefore necessary to provide solutions making it possible to introduce air into the reservoir in the event of insufficiency, and to discharge excess air from the reservoir in the opposite case.

In general, the hydropneumatic reservoir is topped up with air using an air compressor or an external air injector.

The main drawback of air compressors is that the air introduced into the reservoir contains oil droplets or vapors imparted by the compressor. Although the presence of oil thus conveyed into the reservoir is of no trouble where the discharge of waste water is concerned, the same is not true for drinking water supplies.

Air injectors make it possible to eliminate the entrainments of oil in the air injected into the hydropneumatic reservoir. They do not allow the variation in the volume of air in the reservoir to be compensated precisely. Indeed, only trial and error has hitherto allowed the volume of additional air to be conveyed to the reservoir to be fixed especially as a function of the capacity of the reservoir and of the pressure of the water in the pipe, given that the dissolving of air in contact with the water depends on many factors. As a consequence, either an insufficiency or an excess of air injected into the reservoir may occur, which give rise to an inability to provide correct regulation and, for the second case, to pockets of air which may be conveyed by the water into the pipe and give rise to water hammer.

Furthermore, the conventional air injector suffers from other imperfections: the approximate use of the volume available in the injector for the water filling (injection of air into the reservoir)/draining (introduction of air into the device) cycle, the absence of means for protecting the air intake valve of the device against the risk of damage by contact with the water (especially waste water), the absence of concern regarding the quality of the air injected into the reservoir, and in the case of a pipe with submerged pump, the use of a draining siphon in the pipe which creates a loss of efficiency of the submerged pump because of the permanent discharge of water pumped by the siphon, and each start-up of the submerged pipe necessarily leads to an injection of air into the reservoir, even if such an injection is not called for.

The hydropneumatic reservoir generally comprises a hollow body known as a tank which communicates with the pipe for containing the liquid. The tank may or may not be equipped with a bladder. For a bladderless tank, it is necessary to provide a means for injecting air into the tank so as to compensate the dissolution of air in the liquid inside the tank.

Hitherto, the detection that the threshold levels for liquid in a bladderless tank have been exceeded has generally been obtained with the aid of electrical contacts mounted on the lateral wall of the tank through an opening made in the said wall. This solution exhibits drawbacks from the practical point of view, especially the problem of the deposition of dirt on the electrical contacts, the operation of which may thereby be adversely affected, and the difficulties or even impossibility of adjusting the settings.

Moreover, an additional problem exists when air is injected into the hydropneumatic reservoir via the water pipe. This is because the amount of air introduced into the reservoir via the pipe is not total, because some of the air injected into the pipe upstream of the reservoir is conveyed directly by the pipe downstream of the reservoir without entering the reservoir. The result of this is to lessen the efficiency of the system, difficult to determine in any case, and the presence of air in the pipe downstream of the reservoir may pose serious problems from the hydraulics point of view.

The object of the present invention is to overcome the aforementioned drawbacks by proposing an air regulation system for a hydropneumatic reservoir which makes it possible to introduce a volume of air which corresponds precisely to the top-up required by the reservoir.

In addition, a subject of the invention is an air regulation system making it possible to supply a constant volume of air upon each filling/draining cycle of the system.

Another subject of the invention is an air regulation system, the air intake means of which is protected against damage or clogging in contact with the liquid.

A further subject of the invention is an air regulation system which supplies the hydropneumatic reservoir with air compatible with the liquid conveyed in the water pipe, making it possible to avoid contamination of the liquid by the air introduced.

The air regulation system for a hydropneumatic reservoir of a water pipe according to the invention comprises a chamber, a means for filling the chamber with water, a means for draining the chamber of water, a means for automatically introducing air into the chamber during drainage, and a means for automatically injecting air from the chamber toward the reservoir during filling. According to the invention, the system further comprises a control means connected to at least one detector which detects that a threshold level for the liquid contained in the reservoir has been exceeded, and to the means for filling the chamber with water and draining it of water. When the detector supplies a signal corresponding to the volume of air in the reservoir being insufficient, the control means initiates the chamber filling/draining cycle until the detector indicates that the volume of air in the reservoir has become sufficient again.

By virtue of the invention, it is possible accurately to master the problem of air dissolving in contact with the water in the regulation reservoir.

According to one embodiment of the invention, the top of the chamber may be equipped with a liquid level detector connected to the control means to indicate the end of filling of the chamber. The control means may then initiate the chamber draining phase at this precise moment. Likewise, the bottom end of the chamber may be equipped with a liquid level detector connected to the control means to indicate the end of draining to allow the control means to initiate the chamber filling phase. Thus, the volume of air injected into the reservoir is constant for each cycle of filling/draining the chamber of the system and, above all, the chamber filling/draining phases may follow on from one another without dead time as long as the lack of air persists.

Advantageously, the chamber of the air regulation system includes a substantially vertical tube, the lower end of which emerges in the upper wall of the chamber, the upper end of the tube being provided with a solenoid valve for letting air into the chamber. The vertical tube acts as a compression chamber between the air intake solenoid valve and the surface of the liquid in the chamber, preventing the liquid from reaching the air intake solenoid valve, which makes it possible to protect the solenoid valve against any possible damage in contact with the liquid, above all in the case of waste water or chemical liquids.

For preference, the air intake solenoid valve of the system is connected to one end of some piping, the other end of the piping being placed very close to the surface of the water to be pumped, so that the air injected by the system into the reservoir is compatible with the water conveyed by the pipe. This point is particularly important for a drinking water supply pipe so as to avoid any risk of the water being contaminated by the injected air. Indeed, atmospheric air close to the air intake solenoid valve may contain harmful particles which could lower the quality of the water.

According to the invention, the hydropneumatic reservoir may further comprise a hollow bar rendered integral with the reservoir and dipping vertically down into the reservoir. The lower end of the hollow bar is closed so as to form a longitudinal cavity isolated from the inside of the reservoir by the wall of the hollow bar. The detector(s) for detecting that the threshold level has been exceeded is (are) housed in the cavity of the bar.

For preference, the height of the detector(s) in the hollow bar may be adjusted so as to allow the liquid threshold levels in the hollow body of the reservoir to be adjusted as desired. The detector(s) may be of the capacitive type or equivalent, which supplies (supply) different signals when there is presence or absence of the liquid at their level.

By virtue of the invention, the problem of resistance to pressure, of sealing, and of the deposition of impurities which are known for conventional detection means are eliminated, and the reservoir may easily be adapted to regulate the pressure of the liquid to different ranges depending on the requirements associated with the nature of the pipe and with its new desired hydraulic regime. In addition, small diameter hollow bars which withstand high pressures may be selected.

According to another embodiment of the invention, the system comprises an air trap associated with the hydropneumatic reservoir in the case in which the air is injected into the reservoir via the pipe. The air trap makes it possible to prevent air from entering the pipe downstream of the reservoir, which eliminates the problems which may result therefrom and renders the system fully effective.

Figure 1A:
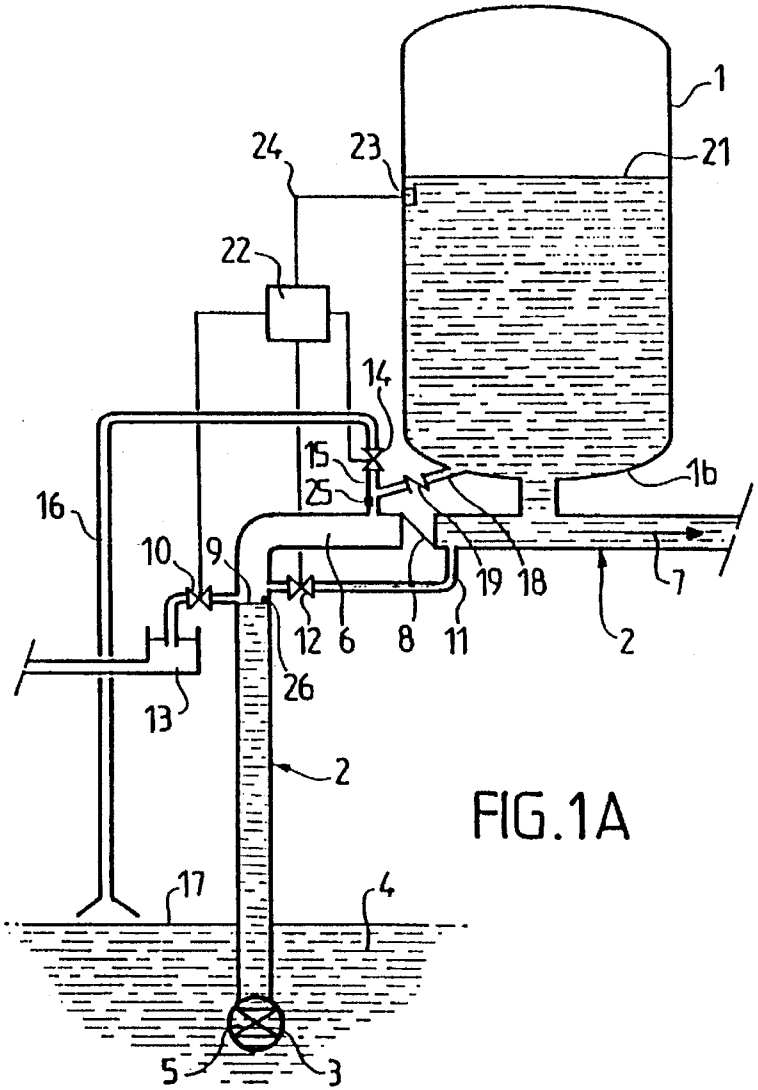
Figure 2:
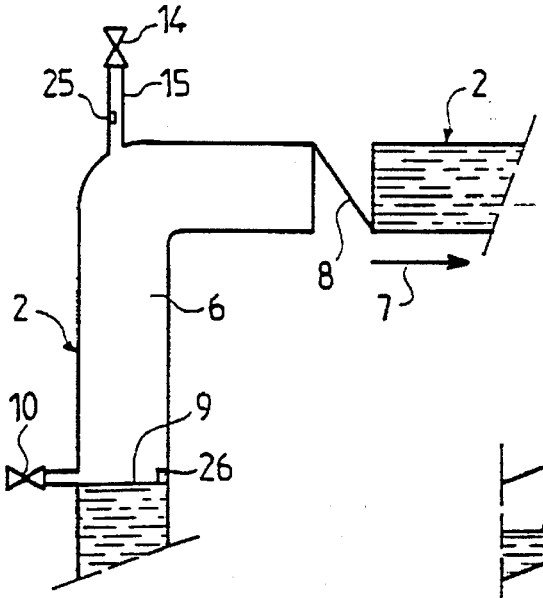
Figure 3:
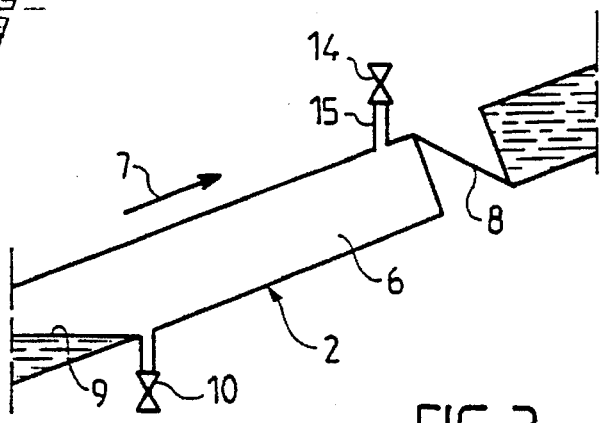
Figure 4:
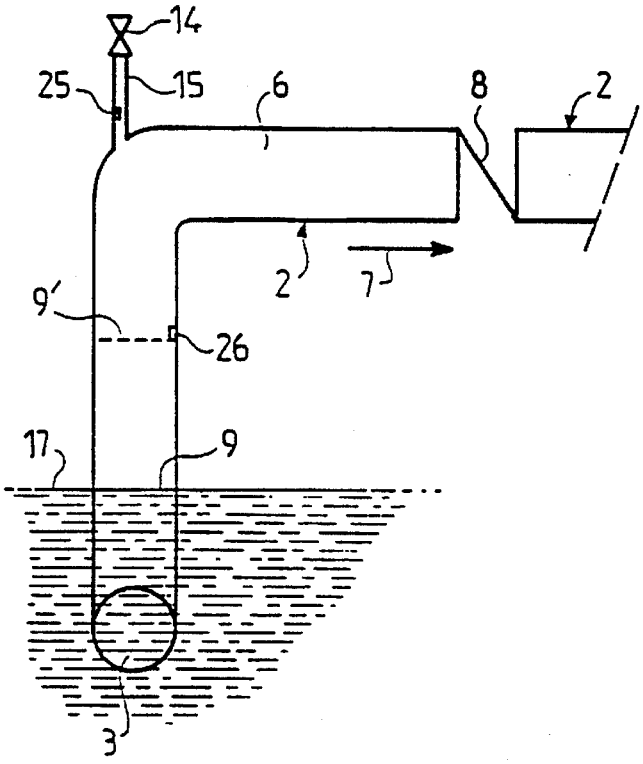
Figure 5:
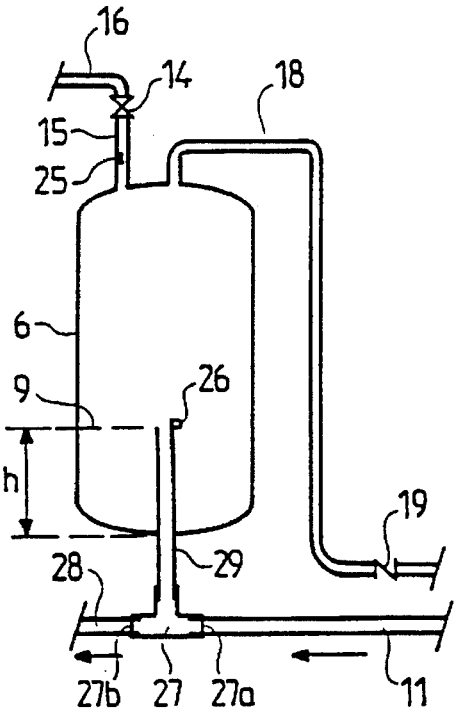
Figure 6:
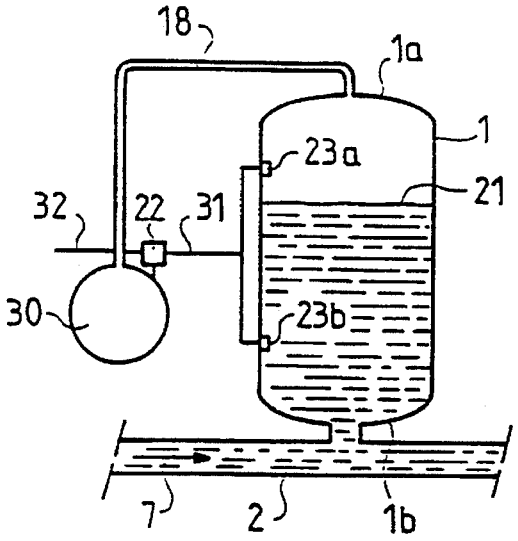
Figure 7:
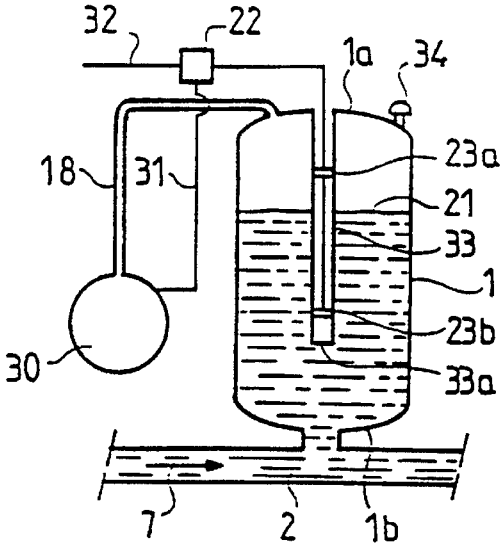
Figure 8:
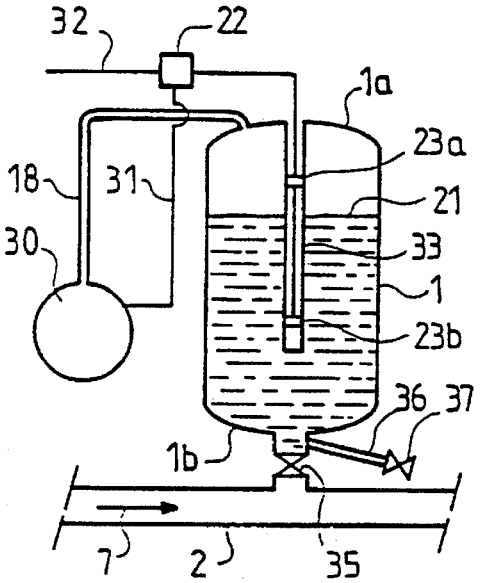
Figure 9:
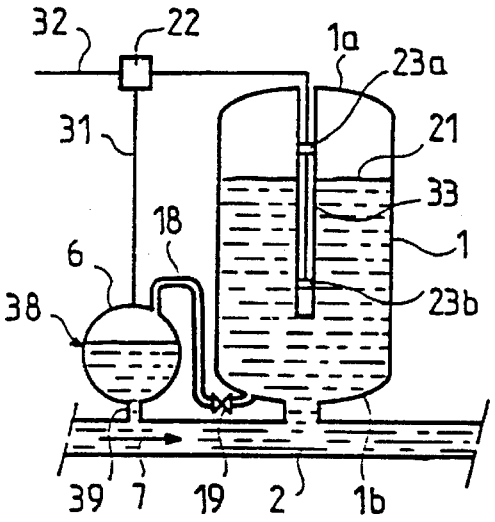
Figure 10:
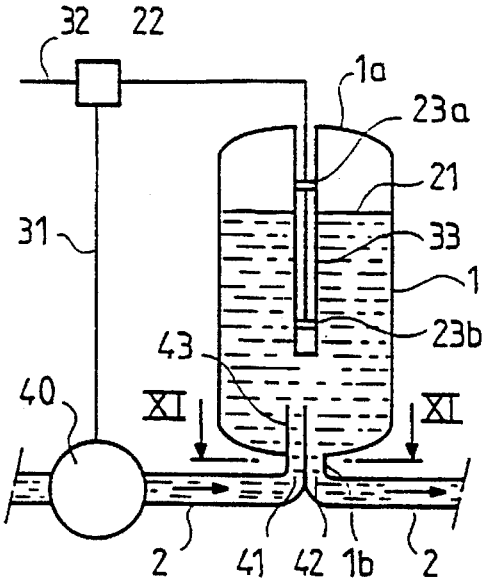
Figure 11:
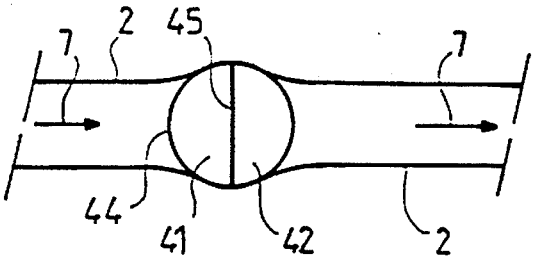
Figure 12:
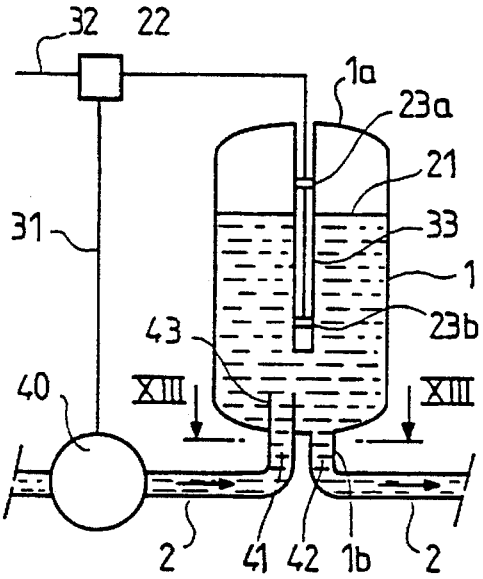
Figure 13:
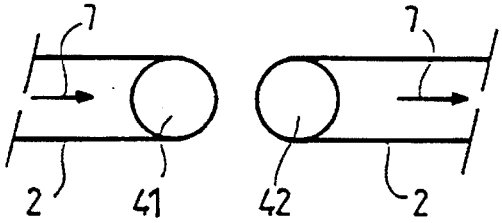
Figure 14:
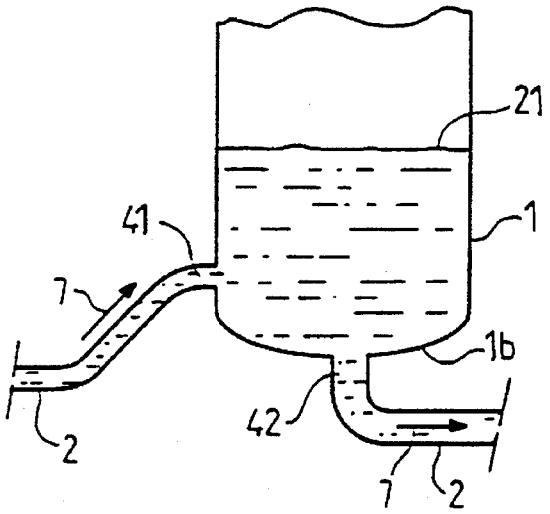
Figure 15:
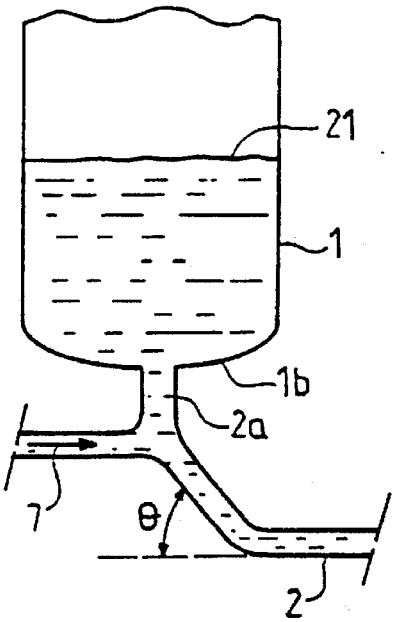
Figure 16:
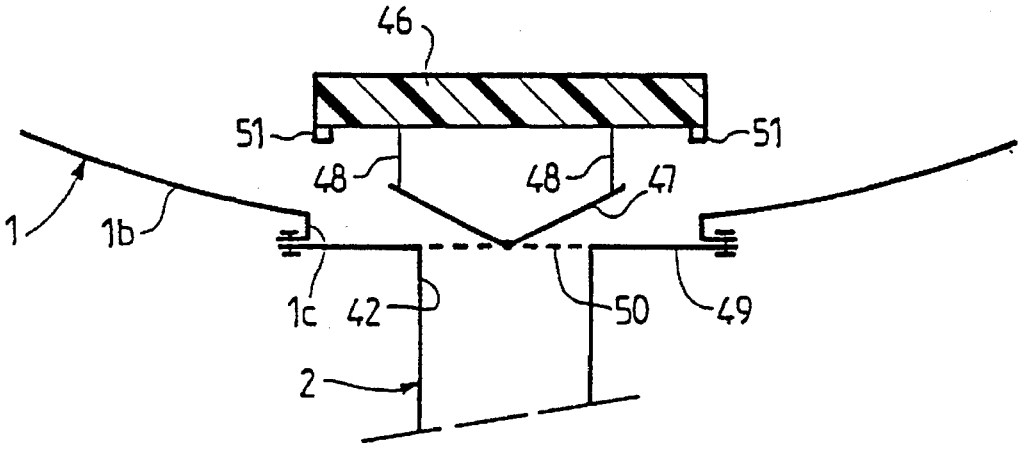

The invention will be better understood and further advantages will emerge from the detailed description of a few non-limiting embodiments illustrated by the appended drawings, in which:

FIGS. 1A, 1B diagrammatically show the operation of the system of the invention, FIGS. 2 and 3 represent two alternative forms of the system with respect to the mode illustrated in FIGS. 1A and 1B, FIG. 4 is an alternative form of the system for the case of a submerged pump without check valve associated with the pump, FIG. 5 illustrates another alternative form of the system of the invention with the chamber separate from the pipe, FIG. 6 is a diagram showing a hydropneumatic reservoir of the invention with the threshold level detectors submerged in the liquid, FIG. 7 is a diagram showing a hydropneumatic reservoir according to the invention with a hollow tube for the threshold level detectors, FIG. 8 is a diagram showing an alternative form of the invention, FIG. 9 is a diagram showing another alternative form of the invention, FIG. 10 is a diagram showing another alternative form of the invention, FIG. 11 is a section on XI—XI of FIG. 10, FIG. 12 is a diagram showing another alternative form of the invention, FIG. 13 is a section on XIII—XIII of FIG. 12, FIG. 14 is a diagram showing an air trap according to the invention, FIG. 15 is a diagram showing another air trap according to the invention, and FIG. 16 is a diagram showing a safety device according to the invention.

As shown in FIGS. 1A and 1B, the air regulation system is intended for a hydropneumatic reservoir 1 in the form of a tank, without bladder, the lower part 1B of which is connected to a water pipe 2. The system comprises an air injection device installed upstream of the reservoir 1 in the pipe 2 and downstream of a feed pump 3 which may or may not be submerged in a water catchment 4 which may be a well, a borehole, or a storage tank. A check valve 5 is associated with the feed pump 3. This is the bottom-end valve of this pump, or a valve installed downstream which prevents any return of water. The valve 5 may be not provided, especially if a water level detector 26 mentioned hereinbelow is installed.

The air injection device comprises a chamber 6 formed by a length of pipe 2, the length 6 being delimited in the normal direction of flow 7 of the water in the pipe 2, on the one hand, at its downstream end, by a non-return valve 8 mounted on the pipe 2 upstream of the reservoir 1 and, on the other hand, at its upstream end, by a water level 9 defined by a water discharge solenoid valve 10. The upstream end of the length forming a chamber 6 has dimensions smaller than the downstream end of the length. Piping 11 links the pipe 2 downstream of the non-return valve 8 to the length 6 so as to allow the chamber 6 to be filled with water. A solenoid valve 12 is installed on the piping 11 to control the filling of the chamber 6 with water by the piping 11. The discharge solenoid valve 10 constitutes a means for draining the chamber 6, the water discharged possibly being collected in a discharge reservoir 13.

The air injection device further comprises an air intake solenoid valve 14 connected on the one hand to the chamber 6 via a vertical tube 15 emerging in the upper wall at the top of the chamber 6 and, on the other hand, to piping 16 which draws air from close to the surface of the water 17 in the water catchment 4. Thus, the air introduced into the chamber 6 via the piping 16, the intake solenoid valve 14 and the vertical tube 15 is compatible with the water conveyed in the pipe 2 (especially free of contamination). The upper wall of the chamber 6 communicates with the lower part 1*b* of the hydropneumatic reservoir 1 via piping 18 equipped with a non-return valve 19.

The principle of injecting air into the reservoir 1 is relatively simple. The feed pump 3 shuts down, the associated valve 5 preventing the water contained in the pipe 2 downstream of the pump 3 from escaping via the latter. If there is a lack of air in the reservoir 1, the discharge solenoid valve 10 opens in order to drain the chamber 6 until the drain level 9 is reached. At the same time as the discharge solenoid valve 10 is opened, the solenoid valve 14 for letting air into the chamber 6 is opened. The non-return valve 8 prevents the water downstream contained in the pipe 2 from entering the chamber 6. Likewise the non-return valve 19 prevents the water from the reservoir 1 from entering the chamber 6. During draining, the filling solenoid valve 12 remains closed.

At the end of draining, the chamber 6 is filled with air as illustrated in FIG. 1A. The water discharge solenoid valve 10 and air intake solenoid valve 14 are then closed and the filling solenoid valve 12 is opened. The piping 11 then allows the chamber 6 to be fed with water contained in the pipe 2 downstream of the non-return valve 8. The air contained in the chamber 6 is driven out along the piping 18 toward the reservoir 1 (FIG. 1B). The air bubbles 20 thus created in the water contained in the reservoir 1 rise up to the surface 21 which represents the separation between the water and the air in the reservoir 1. The air thus introduced into the reservoir 1 therefore contributes to increasing the volume of air in the reservoir. At the end of the phase of filling the chamber 6, if the volume of air introduced is not sufficient, the cycle of draining and of filling the chamber 6 recommences.

According to the invention, the air regulation system comprises a control means 22 which is connected to at least one detector 23 via a link 24 for indicating that the surface of the water 21 has exceeded a threshold level in the reservoir 1 for a given state (pump shut down for example). The control means 22 is also connected to the water discharge solenoid valve 10, water filling solenoid valve 12, and air intake solenoid valve 14 so as to control their openings and closures for the operation of the cycle of filling/draining the chamber 6 as a function of the signal emitted by the detector 23.

In the case illustrated in FIGS. 1A and 1B, the water level 21 in the reservoir 1 when the pump 3 is shut down is above the level of the detector 23 which defines the water level in the reservoir 1 when the pump 3 is shut down for correct inflation of the reservoir 1. This indicates that the volume of air contained in the reservoir 1 has become less than the normal volume necessary, because air has dissolved in the water. The detector 23 submerged in the water then emits a signal to the control means 22 which initiates the cycle of draining/filling the chamber 6 of the device as previously described. When the volume of air supplied via the device to the reservoir 1 is sufficient to compensate for the loss of volume of air in the reservoir 1, the water level 21 in the reservoir reaches the level of the detector 23, which is no longer submerged in the water. The corresponding signal emitted by the detector 23 to the control means 22 allows the latter to stop the cycle of filling/draining the device. When the feed pump 3 starts up to feed the pipe 2, the water discharge solenoid valve 10, water filling solenoid valve 12, and air intake solenoid valve 14 are and remain closed.

In order to improve the accuracy of the volume of air introduced into the reservoir 1 upon each cycle of filling/draining the chamber 6 of the device, but above all so that the phases of filling/draining the chamber 6 can follow on from one another without dead time as long as the lack of air persists, the chamber 6 may optionally be equipped with an upper detector 25 at the top of the chamber in the vertical tube 15 and with a lower detector 26 to indicate the draining level 9 of the chamber 6. The level detectors may be simple electrical contacts which emit different signals in the presence and in the absence of water at their level and which are connected to the control means 22.

FIG. 2 shows an alternative form of the system which differs from the mode previously described by the way in which the chamber 6 is filled and in which the air is injected into the reservoir 1. Indeed in this embodiment, the chamber 6 is filled directly by means of the pump 3. The air contained in the chamber 6 is injected through the non-return valve 8 into the pipe 2 downstream of the valve 8, the pipe 2 conveying the volume of air injected as far as the reservoir 1.

The chamber 6 is formed by a length of pipe 2 which makes an elbow. The vertical part of the elbowed length forms part of the pumping delivery piping of the pipe 2. The vertical tube 15 connecting the air intake solenoid valve 14 and the top of the chamber 6 forms a compression chamber which traps air preventing the water conveyed into the chamber 6 from coming into contact with the intake solenoid valve 14. In this embodiment, each filling of the chamber 6 requires the associated pump 3 to be started up.

The mode illustrated in FIG. 3 is substantially identical to the mode illustrated in FIG. 2, except as regards the shape of the chamber 6 of the system. Instead of having an elbowed length, the chamber 6 may quite simply consist of an inclined length of pipe 2.

FIG. 4 shows a simplified embodiment of the system of the invention. The check valve 5 associated with the pump 3 is eliminated. In this case, shutting down the pump 3 and opening the air intake solenoid valve 14 bring the water level 9 in the pipe to the same level as the surface 17 of the pumped water. By comparison with the embodiment illustrated in FIG. 2, there is no longer any need to provide a discharge solenoid valve 10 or a lower level detector 26 since the draining level 9 will always coincide with the surface 17 of the pumping water. The chamber 6 is filled by means of the pump 3 and the air let into the chamber 6 by the solenoid valve 14 (which is now closed) is driven out into the reservoir 1 via the non-return valve 8 and a portion of pipe 2 upstream of the reservoir 1. The chamber 6 is drained by shutting down the pump 3 and opening the air intake solenoid valve 14 but only, as before, if there is a lack of air in the reservoir 1.

In the case of deep constructions, the height of the pipe 2 thus drained may be too great to inject a correct volume of air into the reservoir 1. All that is then required is to close the air intake solenoid valve 14, either following a given space of time after the pump 3 has been shut down, or when the water level exceeds the lower detector 26 placed at a predetermined height in the pipe 2. The draining level 9' is then above the surface 17 of pumping water. The volume of the chamber 6 of the device may thus be set.

Instead of taking a length of pipe 2 as a chamber for the air injection device, it is possible to provide a chamber 6 separate from the pipe 2 as FIG. 5 shows. It is thus possible to make the device of the invention operate independently of the operating state of the pump 3 associated with the pipe 2 (FIG. 1A), whereas in the case where the chamber 6 forms an integral part of the pipe 2, the device can operate only in relation with the pump 3. The operation of the device according to FIG. 5 is comparable with that illustrated in FIGS. 1A and 1B.

According to FIG. 5, the chamber 6 is produced in the form of a tank, the upper wall of which communicates with the vertical air intake tube 15 and the tube 18 for injecting air toward the reservoir 1 via the non-return valve 19. The chamber 6 is filled and drained by means of a two-way solenoid valve 27, the first path 27*a* of which is connected to the filling piping 11, and the second 27*b* of which is connected to the discharge piping 28. The solenoid valve 27 communicates with the inside of the chamber 6 via a vertical tube 29 passing through the bottom of the tank forming a chamber 6, and the upper end of which may extend beyond the bottom of the chamber by a height h. It will be clearly understood that the draining level 9 of the chamber 6 is defined by the height of the upper end of the vertical tube 29. It is thus possible to set the useful volume of the chamber for injecting air by varying the height h of the vertical tube 29. Advantageously, an upper detector 25 may be provided in the vertical air intake tube 15 and a lower detector 26 at the level rendered integral with the upper end of the vertical communication tube 29. The air injection piping 18 may be connected directly to the reservoir or to the pipe 2 upstream of the reservoir.

According to a specific embodiment of the invention, illustrated in FIG. 6, the regulation system comprises a cylindrical reservoir 1, vertical or horizontal, the ends of which are slightly domed (tank), an air compressor 30 and electrical contacts 23*a*, 23*b*, assuming that this is a hydrophore reservoir (or regulating reservoir) for pumping on demand (or overpressure) with a single pump delivering into the pipe 2 for example. However, what is specified hereinbelow may be generalized, by making minor modifications, to hydrophore reservoirs equipping installations including several pumps and to reservoirs for preventing water hammer.

The air compressor 30 communicates with the inside of the tank 1 via piping 18 emerging in the upper wall 1*a* of the tank 1.

The upper detector 23*a* and the lower detector 23*b* fix the predetermined high threshold and low threshold levels for the liquid in the tank 1 with a view to regulating the flow of liquid into the pipe 2. The high threshold and low threshold levels in the tank 1 correspond to upper and lower extreme pressures defined for the flow of fluid into the pipe 2. The detectors 23*a* and 23*b* are connected on the one hand to the air compressor 30 via a link 31 and on the other hand via a link 32 to one or more pumps which have not been represented and which feed the pipe 2 with liquid.

In normal operation of the regulation system, the tank 1 is partly filled with the liquid which flows in the pipe 2. The level 21 of the liquid in the tank should be between the high threshold and low threshold levels determined by the detectors 23*a* and 23*b*. When the level 21 rises above the height of the detector 23*a*, which corresponds to a liquid pressure which exceeds the upper pressure determined for the network, the detector 23*a* emits a signal to the control means 22 which shuts down the pumping feeding the pipe 2. The continuity of the pressurized liquid supply is then provided by the liquid contained in the tank 1 which feeds the pipe 2 via its lower part 1*b*. The tank 1 therefore drains and when the liquid level 21 drops below the height of the lower detector 23*b*, which means that the pressure of the liquid in the pipe 2 has dropped below the permitted lower limit, the detector 23*b* sends a signal to the control means 22 which delivers a start-up signal via the link 32 to switch on the pump. The pressure in the pipe 2 therefore increases again and the level of the liquid 21 in the tank 1 increases. In this way, the pressure of the liquid in the pipe 2 can be regulated.

The operation of this regulation system as has just been described requires the tank 1 to be correctly inflated, not only as regards its initial inflation, but also to compensate for a decrease in the air volume inside the tank 1, which decrease is due to air dissolving in the liquid.

The initial inflation of the tank determines the upper and lower extreme pressures of the network corresponding to the height of the detectors 23*a* and 23*b* of the tank. Poor initial inflation of the tank would therefore lead to a shift of the range of permissible pressures either to higher values or to lower values, which could be detrimental to the pipe 2 and possibly to users.

Starting from correct inflation of the tank, when the pump shuts down (is shut down for a reservoir for preventing water hammer), if the level 21 of the liquid is above the upper threshold level indicated by the detector 23*a*, that indicates that the inflation of the tank 1 has become insufficient. The detector 23*a* submerged in the liquid sends a signal to the air compressor 30 via the control means 22 and the link 31. The air compressor 30 starts up and sends compressed air to the tank via the piping 18 until the level 21 of the liquid reaches the level of the detector 23*a*, which then emits a shut down signal to the air compressor 30 via the control means 22 and the link 31. The inflation of the tank is correctly re-established.

The regulation system described above has the detectors 23*a* and 23*b* fixed to the internal wall of the tank 1 and exposed to the liquid which may contain impurities. The deposition of impurities on the detectors 23*a* and 23*b* may adversely affect their operation in the long term. Furthermore, it is necessary to make openings through the lateral wall of the tank 1 in order to attach the detectors 23*a* and 23*b*, and there is no possibility for easily altering the position of these detectors, or thus of altering the settings.

FIG. 7 illustrates a regulation system of the invention in an operating mode comparable to the system described previously and illustrated in FIG. 6. The regulation system comprises a hollow bar 33 dipping down vertically into the tank 1 from its upper part 1*a*. The lower end 33*a* of the hollow bar 33 is closed so as to isolate the inside of the hollow bar 33 completely with respect to the inside of the tank 1. By adopting the same assumption as before, that is to say a hydrophore reservoir and a single pump, two level detectors 23*a* and 23*b* are located inside the hollow bar 33 with a predetermined difference in height defining a high threshold level and a low threshold level for the liquid in the tank 1.

For preference, the hollow bar 33 is made in tubular shape and mounted coaxially with the tank 1. The central tube 33 is made of a nonmetallic substance to allow the installation of detectors 23*a*, 23*b* of the capacitive type, or equivalent. The central tube 33 may also be made of metal if detectors other than capacitive-type detectors which can act through metal walls are used. Advantageously, the sensors 23*a* and 23*b* may be set in terms of height inside the central tube 33 so as to adapt the tank 1 to the pressure requirements of the pipe 2. To render the sensors 23*a* and 23*b* height-adjustable, link rods dipping down into the tube 33 and on which the detectors are mounted may be used. It is equally possible to envisage limit stops at given heights in the tube onto which to fasten the detectors. The detectors 23*a* and 23*b* are protected against the deposition of impurities conveyed by the liquid by the wall of the central tube 33.

The tank 1 may include a relief valve 34 at its upper wall 1*a*, which valve allows air inside the tank 1 to be discharged to the outside, and this is for the purpose of preventing an undesirable overpressure inside the tank 1. This may be the case, for example, if the liquid gives off a gaseous mixture, for example air, in the tank.

The operation of the system illustrated in FIG. 7 for regulating the pressure in the pipe is identical to the operation of the system of FIG. 6 and will not be described further.

Of course, as indicated before, the number of level detectors used for the reservoir may vary as required. For example, in the case where the reservoir is used as a tank for preventing water hammer, just one level detector, such as the high threshold level detector 23*a* inside the central tube 33 may suffice. The air compressor 30 is started up by the detector 23*a* in the event of the volume of air in the tank 1 being insufficient in the same way as above.

For the other embodiments of the invention which are illustrated in FIGS. 8 to 13, the system may operate either for regulating the pressure in the pipe 2 or for preventing water hammer in the pipe 2. Likewise, a relief valve 34 may be provided on the upper wall 1*a* of the tank 1 if need he. Given that the operating principles of the various embodiments of the invention are comparable with each other, merely their differences will be described.

According to the mode illustrated in FIG. 8, the lower part 1*b* of the tank 1 is provided with an airtight valve 35 which controls the communication between the tank 1 and the pipe 2. Discharge piping 36 is provided between the lower part 1*b* of the tank and the valve 35. The discharge piping 36 is connected to a drain cock 37. Such equipment makes initial inflation of the tank 1 easier, either upon commissioning of the reservoir, or after the installation has been shut down for a protracted length of time (in irrigation for example). To do this, the valve 35 is closed and the drain cock 37 is opened. When the tank 1 has been emptied, the drain cock 37 is closed and the tank 1 is inflated, by virtue of the piping 18 emerging in its upper part 1*a*, with compressed air from the air compressor 30 or from a compressed air cylinder, up to the desired pressure corresponding to the correct inflation of the tank. Injection of air is than halted and the valve 35 is opened to re-establish communication between the tank 1 and the pipe 2.

The equipment which has just been described may be used for the other embodiments described and illustrated. All that is required is to provide an orifice at the upper part of the reservoir to allow initial inflation of the reservoir using a cylinder of compressed air.

The reservoir according to FIG. 9 differs from the one illustrated in FIG. 7 in the design of the means for injecting air into the tank 1. Instead of having an air compressor 30 which runs the risk of introducing oil droplets or vapors into the air injected into the tank 1, an air injection device 38 is used which is connected on the one hand to the pipe 2 via piping 39 and on the other hand either to the lower part of the tank 1 or to the pipe 2 upstream of the tank 1 via piping 18 provided with a non-return valve 19. The device 38 allows air to be introduced into the tank 1 by virtue of cycles of draining and of filling an auxiliary reservoir or chamber 6 of the device. Filling the auxiliary reservoir 6 with liquid drives the air at the upper part of the auxiliary reservoir of the device into the tank 1 via the linking piping 18, the non-return valve 19 preventing the air and liquid from returning to the auxiliary reservoir 6.

As illustrated in FIG. 10, the regulation system comprises an air injection device 40 which is incorporated into the pipe 2 upstream of the tank 1 so as to inject air, if need he, into the tank 1 via the pipe 2. A few embodiments of the air injection device 40 have already been described previously and illustrated in FIGS. 1 to 4.

At the lower part 1*b* of the tank 1, the pipe 2 has an inlet 41 and an outlet 42 for liquid in the tank 1. The inlet 41 may be extended vertically upward by piping 43 projecting inside the tank 1. The purpose of such a projection 43 is to create an air trap for air injected into the liquid by the air injection device 40. The air conveyed by the liquid introduced into the tank 1 via the inlet 41 rises up in the tank 1 as far as the separation surface 21 between the air and the liquid which are contained in the tank 1 or reaches the air region directly if this surface 21 is situated below the top of the piping 43. This configuration therefore avoids any loss in useful volume in the tank 1.

FIG. 12 shows an alternative form of the air trap consisting of the inlet 41, the possible vertical extension 43 and the outlet 42 of the liquid at the lower part 1*b* of the tank 1. The difference in structure of the air trap between the embodiments illustrated in FIGS. 10 and 12 is better illustrated by FIGS. 11 and 13.

In order not to create a head loss in the pipe 2, it is preferable to have the same transverse section for the inlet 41 as for the pipe 2 immediately upstream of the tank 1. The same is true for the cross section of the outlet 42 situated at the bottom of the tank 1 with respect to the section of the pipe 2 immediately downstream of the tank 1. As illustrated in FIG. 11, the inlet 41 and the outlet 42 consist of two compartments of tubular piping 44 which is separated by a central wall 45. The section of the tubular piping 44 advantageously corresponds to the sum of the sections of the pipe 2 immediately upstream and downstream of the tank 1. According to FIG. 13, the inlet 41 and the outlet 42 are independent of one another and consist of a simple elbow of the pipe 2 emerging in the lower part 1*b* of the tank 1.

Of course, the concept of an air trap is used only for the case where air is injected into the tank 1 via the pipe 2. Apart from the structures illustrated in FIGS. 10 to 13, the air trap may adopt various shapes, indeed all that is required is for it to be impossible for air introduced into the tank 1 via the inlet 41 to escape with the liquid at the outlet 42.

In general, in order to trap air in the tank 1, the inlet 41, possibly with its extension 43, must be situated at a level above the outlet 42.

FIGS. 14 and 15 show two other embodiments of the air trap. According to FIG. 14, the inlet 41 emerges in the lateral wall of the tank 1 above the bottom of the tank, and the outlet 42 emerges at the bottom of the tank. This embodiment is especially suited to waste water, since strands or other long bodies conveyed by the liquid in the pipe 2 run the risk of becoming entangled around the extension 43 of the inlet 41 illustrated in FIGS. 10 to 13.

The air traps previously described require that all the water pumped should pass through the tank. In the case of waste water, there is the risk of entrainment of deposits at the bottom of the tank, because all the matter transported in waste water passes through the tank 1. The problem may be solved by the mode illustrated in FIG. 15. The pipe 2 has a part 2*a* with three openings which is situated immediately below the tank 1. The upper opening of the part 2*a* emerges in the lower part 1*b* of the tank 1. The liquid enters via the intermediate opening of the part 2*a* and leaves via the lower opening of this portion of pipe. The intermediate opening and lower opening are connected by a length of piping which is vertical or inclined by an angle $\theta$ at least equal to 45° with respect to the horizontal.

The air trap according to FIG. 15 therefore makes it possible to limit the amount of matter transported by the waste water which passes through the tank 1.

In order to prevent accidental complete draining of the tank 1 and leakage of air from the tank into the pipe 2, a safety device may be provided at the lower part 1*b* of the tank at the liquid outlet 42.

As illustrated in FIG. 16, the safety device comprises a float 46 made of lightweight material, such as a foam or a plastic, a flexible membrane 47 and flexible hangers 48. The flexible membrane 47 is fixed to the float 46 by the flexible hangers 48. The lower part 1*b* of the tank has an opening 1*c* sealed off by a horizontal plate 49 fixed to the tank 1 by means of bolts. The plate 49 has an opening communicating with the outlet 42 for the liquid, a grid 50 being provided on this opening.

The float 46 on which the upthrust of the liquid acts, keeps the flexible membrane 47 fixed to the centre of the grid 50 domed upward. The water can therefore pass through the outlet 42. When the water level in the tank 1 drops excessively, the float 46 lowers and the membrane 47 is pressed against the grid 50 and against the plate 49, which prevents complete draining of the tank 1. Studs 51 may be provided on the lower face of the float 46, allowing the pressure of the liquid to be exerted uniformly on the membrane 47 even when the float 46 is in contact with it.

I claim:

1. Air regulation system for a hydropneumatic reservoir (1) of a water pipe (2), comprising a chamber (6), a means (11, 12; 3; 11, 27*a*) for filling the chamber with water, a means (10, 13; 27*b*, 28) for draining the chamber of water, a means (14, 15, 16) for automatically introducing air into the chamber during drainage, a means (18, 19; 8) for automatically injecting air from the chamber toward the reservoir during filling, and said air regulation system further comprises a control means (22) connected to at least one detector (23; 23*a*, 23*b*) which detects that a threshold level for the water contained in the reservoir has been exceeded, and to the means for filling and draining the chamber, and that if, for a given state, the detector indicates that the volume of air contained in the reservoir is insufficient for this state, the control means initiates chamber filling/draining cycles until the detector indicates that the volume of air in the reservoir has become sufficient.

2. System according to claim 1, characterized in that it comprises an upper water level detector (25) placed at the top of the chamber (6) and connected to the control means (22) to indicate the end of filling of the chamber.

3. System according to claim 2, characterized in that it comprises a lower water level detector (26) located at the bottom end of the chamber and connected to the control means (22) to indicate the end of draining of the chamber.

4. System according to claim 2, characterized in that the chamber (6) includes a vertical tube (15) for introducing air, the lower end of which emerges at the top of the chamber, and the upper end of which communicates with an air intake solenoid valve (14), the vertical tube constituting a compression chamber between the air intake solenoid valve and the water in the chamber.

5. System according to claim 4, characterized in that the upper detector (25) is mounted in the vertical tube (15).

6. System according to claim 1, characterized in that the chamber (6) includes a vertical tube (15) for introducing air, the lower end of which emerges at the top of the chamber, and the upper end of which communicates with an air intake solenoid valve (14), the vertical tube constituting a compression chamber between the air intake solenoid valve and the water in the chamber.

7. System according to claim 1, characterized in that said means for automatically introducing air comprises piping (16) with one end of said piping (16) situated close to a surface (17) of a water source for the hydropneumatic reservoir (4).

8. System according to claim 1, characterized in that the chamber (6) is formed by a length of pipe (2) delimited in the normal direction of flow (7) of the liquid in the pipe, on the one hand, at its downstream end, by a non-return valve (8) mounted on the pipe upstream of the reservoir (1) and, on the other hand, at its upstream end, by a draining level (9) defined by the draining means, the dimension of the upstream end of the length being less than that of its downstream end.

9. System according to claim 8, characterized in that the means for automatically injecting air injects a predetermined volume through the non-return valve (8) into the pipe (2) upstream of the reservoir (1).

10. System according to claim 8, characterized in that said filling means comprises a solenoid valve (12) mounted on filling piping (11), one end of which emerges in the pipe (2) downstream of the non-return valve (8) and another end of which emerges in the chamber (6).

11. System according to claim 8, characterized in that the means for automatically injecting air injects a predetermined volume directly into a lower part of the reservoir by means of piping provided with a non-return valve (19).

12. System according to claim 8, characterized in that said filling means comprises a pump which under normal circumstances feeds the pipe (2).

13. System according to claim 1, characterized in that the chamber (6) consists of a tank separate from the pipe (2), and that the filling and draining means consist of a two-way solenoid valve (27) communicating with the chamber (6) via a vertical tube (29) passing through the lower wall of the chamber, it being possible for the vertical tube (29) to extend beyond the bottom of the chamber by an adjustable height (h) inside the chamber.

14. System according to claim 1, characterized in that it comprises a hollow bar (33) rendered integral with the hydropneumatic reservoir (1) and dipping vertically down into the reservoir, the lower end (33*a*) of the bar being closed and thus delimiting a cavity in the hollow bar, and that the threshold-exceeded detector (23*a*, 23*b*) is housed in the cavity of the hollow bar.

15. System according to claim 14, characterized in that the threshold-exceeded detector (23*a*, 23*b*) is located in the cavity of the hollow bar in a height-adjustable fashion.

16. System according to claim 14, characterized in that the threshold-exceeded detector is of a capacitive type which supplies different signals in the presence or in the absence of liquid at its level.

17. System according to claim 14, characterized in that the reservoir (1) is substantially cylindrical, vertical or horizontal, closed at both sides, and that the hollow bar (33) is of tubular shape rendered integral with an upper wall (1*a*) of the reservoir.

18. System according to claim 1, characterized in that it comprises a relief valve (34) at an upper part (1*a*) of the reservoir (1), making it possible to discharge air in the event of overpressure in the reservoir.

19. System according to claim 1, characterized in that it comprises a valve (35) positioned for controlling liquid communication between the pipe (2) and a lower part (1*b*) of the reservoir, and that it comprises discharge piping (36), one end of which emerges in the lower part of the reservoir above the valve (35), and another end of which includes a drain cock (37).

20. System according to claim 1, characterized in that the automatic injection means (18, 19; 8; 40) injects air into the reservoir (1) via the pipe (2), and that a link between a lower part (1*b*) of the reservoir and the pipe has an air trap (41, 42, 43; 2*a*).

21. System according to claim 20, characterized in that the air trap consists of an inlet (41) for the liquid emerging in the lower part (1*b*) of the reservoir which may be extended upward by piping (43), and an outlet (42) for the liquid, also emerging at the lower part of the reservoir, the respective cross section of the inlet and of the outlet being substantially identical to the cross section of the pipe (2) immediately upstream and downstream of the reservoir.

22. System according to claim 20, characterized in that the air trap consists of an inlet (41) for the liquid emerging in the lower part (1*b*) of the reservoir and of an outlet (42) for the liquid, also emerging in the lower part of the reservoir, the inlet being situated above the outlet for the liquid.

23. System according to claim 20, characterized in that the air trap consists of a portion (2*a*) of pipe situated below the lower part (1*b*) of the reservoir, the said portion of pipe having an upper opening emerging into the lower part of the reservoir, an intermediate opening via which the liquid arrives, and a lower opening via which the liquid is discharged, the intermediate opening and lower opening being situated respectively at the level of the pipe immediately upstream of the reservoir and at the level of the pipe immediately downstream of the reservoir.

24. System according to claim 23, characterized in that the intermediate opening and lower opening are linked by a length of pipe making an angle (θ) greater than or equal to 45° with respect to the horizontal.

25. System according to claim 1, characterized in that a lower part (1*b*) of the reservoir has an opening (1*c*) for the outlet of the liquid, which is connected to the pipe (2), and a safety device interacting with the said opening to prevent complete drainage of the reservoir and the leakage of air into the pipe from the reservoir.

26. System according to claim 25, characterized in that the safety device comprises a float (46), a flexible membrane (47) suspended from the float by flexible hangers (48) and a plate (49) provided with a central grid (50) covering the section of the pipe (42) emerging in the opening (1*c*) of the reservoir, the membrane being fixed at its center to the grid and being capable of completely covering the grid.

27. System according to claim 26, characterized in that the float (46) is in the form of a horizontal plate provided with several studs (51) on the lower surface which may come into contact with the plate (49) provided with the grid (50).

* * * * *